US005657040A

United States Patent [19]

Kanbara

[11] Patent Number: 5,657,040

[45] Date of Patent: Aug. 12, 1997

[54] DRIVING APPARATUS FOR STABLY DRIVING HIGH-DEFINITION AND LARGE SCREEN LIQUID CRYSTAL DISPLAY PANELS

[75] Inventor: Minoru Kanbara, Hachioji, Japan

[73] Assignee: Casio Computer Co., Ltd., Tokyo, Japan

[21] Appl. No.: 356,107

[22] Filed: Dec. 15, 1994

[30] Foreign Application Priority Data

Dec. 29, 1993 [JP] Japan ..... 5-353902
Apr. 22, 1994 [JP] Japan ..... 6-107877

[51] Int. Cl.[6] ..... G09G 3/36

[52] U.S. Cl. ..... 345/98

[58] Field of Search ..... 345/98–100, 205, 345/206

[56] References Cited

U.S. PATENT DOCUMENTS 4,931,787 6/1990 Shannon ..... 345/206
5,028,916 7/1991 Ichikawa et al. ..... 345/98
5,250,931 10/1993 Misawa et al. ..... 345/206
5,252,957 10/1993 Itakura ..... 345/98

*Primary Examiner*—Jeffery Brier
*Attorney, Agent, or Firm*—Frishauf, Holtz, Goodman, Langer & Chick

[57] ABSTRACT

An active matrix array of display elements and nine drain line drivers are formed on a substrate. The drain line drivers are separated into three groups each containing three drain line drivers. Individual drain lines are connected to different drain line drivers in a layout order. Clock signals, which are obtained by frequency-dividing a D-clock signal to one ninth and which have phases shifted from one another by 120 degrees, are supplied via three clock signal lines that commonly connect associated drain line drivers in the individual groups in parallel. All the drain line drivers in each group are connected in parallel by a data signal line. Thinned video data signals obtained by separating input video data by three are supplied via the three data signal lines group by group.

11 Claims, 6 Drawing Sheets

DRIVING APPARATUS FOR STABLY DRIVING HIGH-DEFINITION AND LARGE SCREEN LIQUID CRYSTAL DISPLAY PANELS

BACKGROUND OF THE INVENTION

1. Field of the Invention

The present invention relates generally to a display driving apparatus, and more particularly, to a display driving apparatus which drives high-definition and large screen liquid crystal display panel.

2. Description of the Related Art

Recently, thin film transistor (TFT) liquid crystal (LC) display panels having TFTs as switching elements for the individual pixels became very popular. There is demand for higher definition and larger screens for LC display panels. Because of slow switching of TFTs, however, it is difficult to ensure a satisfactory operation speed for the higher definition and larger screen of the LC display panels.

To cope with the higher definition and larger screen of the LC display panels, there has been proposed an active matrix display apparatus in which the data side driver is separated into a plurality of sub sections that are operable in parallel as shown in FIG. 1. The active matrix display apparatus shown in FIG. 1 is disclosed Japanese Unexamined Patent Publication No. 61-5263. The contents of Japanese Unexamined Patent Publication No. 61-52631 are incorporated in this specification by reference.

The active matrix LC display apparatus in FIG. 1 comprises an active matrix array 2, a gate line driver 3 for driving the gate lines and three drain line drivers 4, 5 and 6 as the data side drivers which drive the drain lines. The gate line driver 3 sequentially scans the gate lines in the vertical direction in synchronism with a G-clock signal.

In synchronism with a D-clock signal, the drain line drivers 4, 5 and 6 receive one scan line of separated video signals Vv1, Vv2 and Vv3 as serial data.

The above will be discussed more specifically. The active matrix LC display apparatus 1 has a shift register 7, sample and hold circuits 8 and 9, and shift registers 10, 11 and 12 as external circuits. Video signals are sequentially written in the sample and hold circuit 8 by the shift register 7.

When scanning of the next scan line starts, the video signals written in the sample and hold circuit 8 are transferred to the sample and hold circuit 9. The video signals held in the sample and hold circuit 9 are separated into three, a third of one scan line each, by the shift registers 10, 11 and 12. The trisected video signals are written in serial in the associated drain line driver 4, 5 or 6 in synchronism with the D-clock signal.

Connected to the drain line drivers 4, 5 and 6 are the associated drain lines of the active matrix array 2. The drain line drivers 4, 5 and 6 simultaneously send the video signals to the associated drain lines.

The D-clock signal merely needs one third of the clock frequency of the one used in the case where the drain lines are driven by a single drain line driver. It is therefore possible to surely drive the active matrix LC display apparatus 1 having a large screen.

In the conventional display driving apparatus, as mentioned above, the frequency of the D-clock signal is reduced to ⅓ by simultaneously supplying data to three drain lines from the drain line drivers 4, 5 and 6. When this display driving apparatus is adapted for a television receiver, for example, it can sufficiently cope with the NTSC system. If the display driving apparatus is adapted for a display apparatus for an HDTV (High-Definition TV) or the like which uses many pixels on one scan line, however, a simple frequency reduction to ⅓ is not good enough for the required operation speed of the switching elements and cannot secure a sufficient driving time. This would deteriorate the image quality.

SUMMARY OF THE INVENTION

Accordingly, it is an object of the present invention to provide a display driving apparatus which can stably drive a high-definition and large screen display apparatus even if thin film transistors with a low operation speed are used as the switching elements of drivers.

To achieve this object, a display driving apparatus according to one aspect of this invention comprises a display panel having a plurality of display elements laid out on a substrate in a predetermined pattern; a data side driver section, formed on the substrate, for supplying data to the display elements, the data side driver section having a plurality of groups each including a plurality of data side drivers; a column of data lines arranged in parallel and each connected to a plurality of display elements and to one of the data side drivers which is associated with a position of a column of the connected display elements; a scan side driver for scanning the display elements by a plurality of numbers; a plurality of scan lines for each connecting a plurality of display elements to the scan side driver; clock signal supply means for supplying a common clock signal to each associated one of the data side driver in each of the groups; and data signal supply means for supplying a common data signal to all of the data side drivers in each of the groups, group by group.

According to the above display driving apparatus, one scan line of input video signals are separated into the number of groups of the data side drivers. Further, the separated video signals are commonly supplied to all the data side drivers in the associated group. The associated data side drivers in the individual groups are driven at a time, and sets of those associated data side drivers are driven at timings shifted by the phases corresponding to the number of the data side drivers in each group or the number of the driver sets.

It is therefore possible to set the frequency of the clock signal for driving the data side drivers in inverse proportion to the product of the number of groups of the data side drivers and the number of the data side drivers constituting each group. Even if slow switching elements are used, it is possible to ensure a sufficient driving speed to cope with display panels having high definition and large screens. Accordingly, high-definition display panels can be driven with a high quality.

It is preferable that the data side drivers be separated so that each group of the data side drivers includes the same number of data side drivers. In this case, it is preferable that the number of data side drivers in group is S, and individual data lines in the column of data lines should be connected to the same data side driver with (S−1) data lines, connected to other data side drivers in the same group, in between.

It is also preferable that the number of the groups is r and the number of data side drivers in a group is S, and individual data lines in the column of data lines are connected to a same data side driver with (r·S−1) data lines, connected to other data side drivers, in between in the above display driving apparatus.

Further, it is preferable that the scan side driver be formed on the same substrate.

Furthermore, it is preferable that a plurality of clock signal lines connected to associated data side drivers in the groups in the display driving apparatus should be provided as the clock signal supply means. In this case, the clock signal supply means should preferably include a clock signal generator for frequency-dividing a reference clock signal to the reciprocal of the product of the number of the groups and the number of the data side drivers constituting each group and generating clock signals whose phases are shifted by phase angles corresponding to the number of the data side drivers constituting each group. It is preferable that this clock signal generator should have a first counter for frequency-dividing the reference clock signal in accordance with the number of the groups, and second counters equal in number to the data side drivers included in each group for frequency-dividing a clock signal output from the first counter, in accordance with the number of the data side drivers included in each group.

In addition, it is preferable that the data signal supply means should have a plurality of data signal lines commonly connected to all of the data side drivers in each of the groups should be provided as the data signal supply means. In this case, it is preferable to provide, as the data signal supply means, a data signal generator for separating one scan line of input video signals in accordance with the number of the groups and respectively supplying the separated video signals to the data signal lines. It is preferable that this data signal generator should have shift registers equal in number to the groups.

To achieve the aforementioned object, a display driving apparatus according to another aspect of this invention comprises a display panel having a plurality of display elements laid out on a substrate in a predetermined pattern; a data side driver section, formed on the substrate, for supplying data to the display elements, the data side driver section having a plurality of groups each including a plurality of data side drivers; a column of data lines arranged in parallel and each connected to a plurality of display elements and connected to a same data side driver with (S−1) data lines, connected to other data side drivers in a same group, in between, where S is the number of data side drivers in the same group; a scan side driver for scanning the display elements by a plurality of numbers; a plurality of scan lines for each connecting a plurality of display elements to the scan side driver; and clock signal supply means for supplying a common clock signal to an associated one of the data side driver in each of the groups.

To achieve the aforementioned object, a display driving apparatus according to a further aspect of this invention comprises a display panel having a plurality of display elements laid out on a substrate in a predetermined pattern; a data side driver section, formed on the substrate, for supplying data to the display elements, the data side driver section having a plurality of groups each including a plurality of data side drivers; a column of data lines arranged in parallel and each connected to a plurality of display elements and connected to a same data side driver with (r·S−1) data lines, connected to other data side drivers, in between, where r is the number of the groups and S is the number of data side drivers in the same group; a scan side driver for scanning the display elements by a plurality of numbers; a plurality of scan lines for each connecting a plurality of display elements to the scan side driver; and clock signal supply means for supplying a common clock signal to an associated one of the data side driver in each of the groups.

BRIEF DESCRIPTION OF THE DRAWINGS

FIGS. 4A through 4M are timing charts respectively showing an analog video signal DATA, a D-clock signal, the output of a counter 57, thinned video signals $V_A$, $V_B$ and $V_C$, and a clock signal CT1, control signals ϕ1, ϕ4, a clock signal CT2, a control signal ϕ2, a clock signal CT3, and a control signal ϕ3 in the first embodiment;

DETAILED DESCRIPTION OF THE PREFERRED EMBODIMENTS

Preferred embodiments of the present invention will now be described referring to FIGS. 2 through 6.

Figure 1:
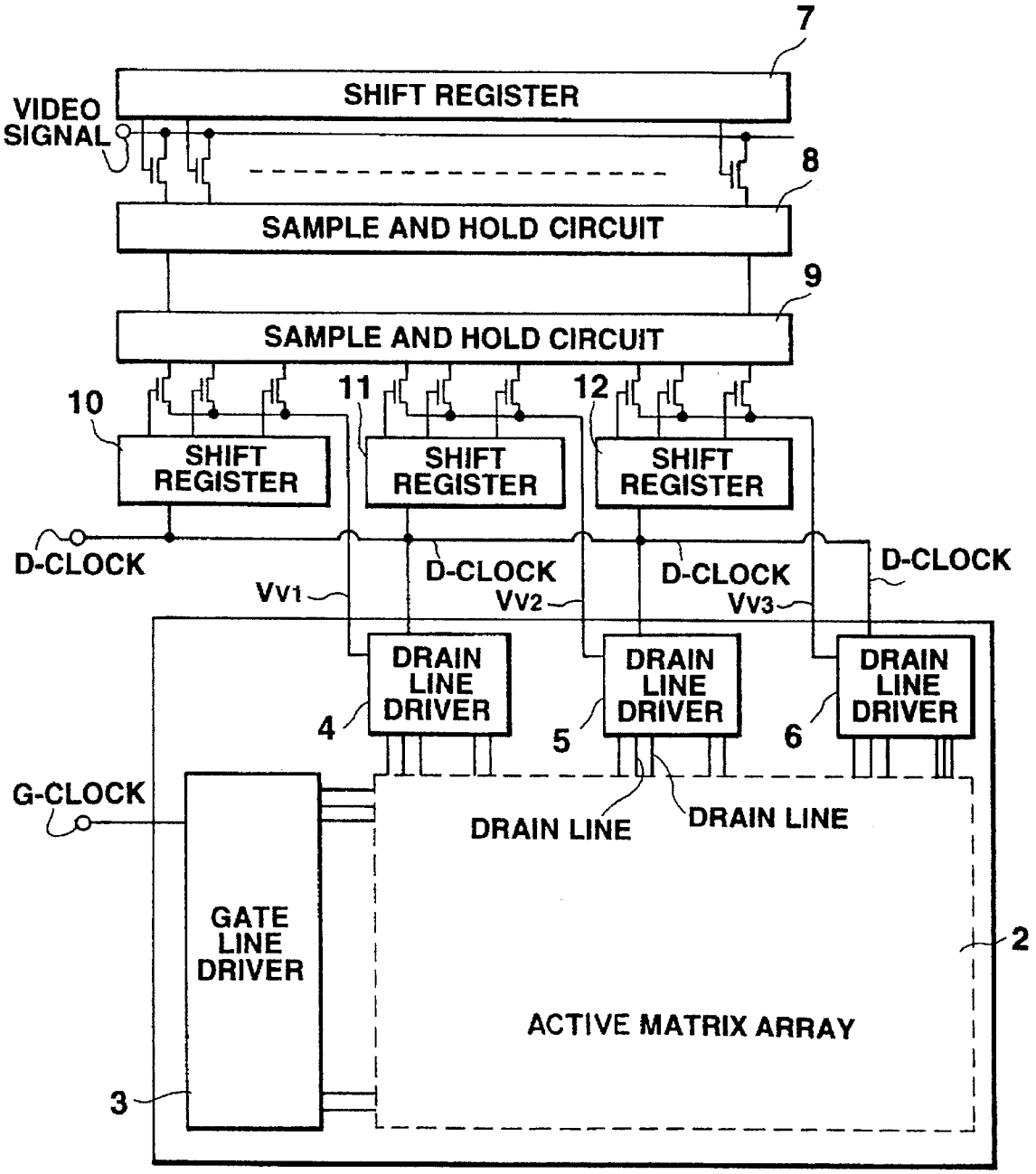
FIG.1 (PRIOR ART)
FIG. 1 is a circuit diagram showing a conventional displaying apparatus.
Figure 2:
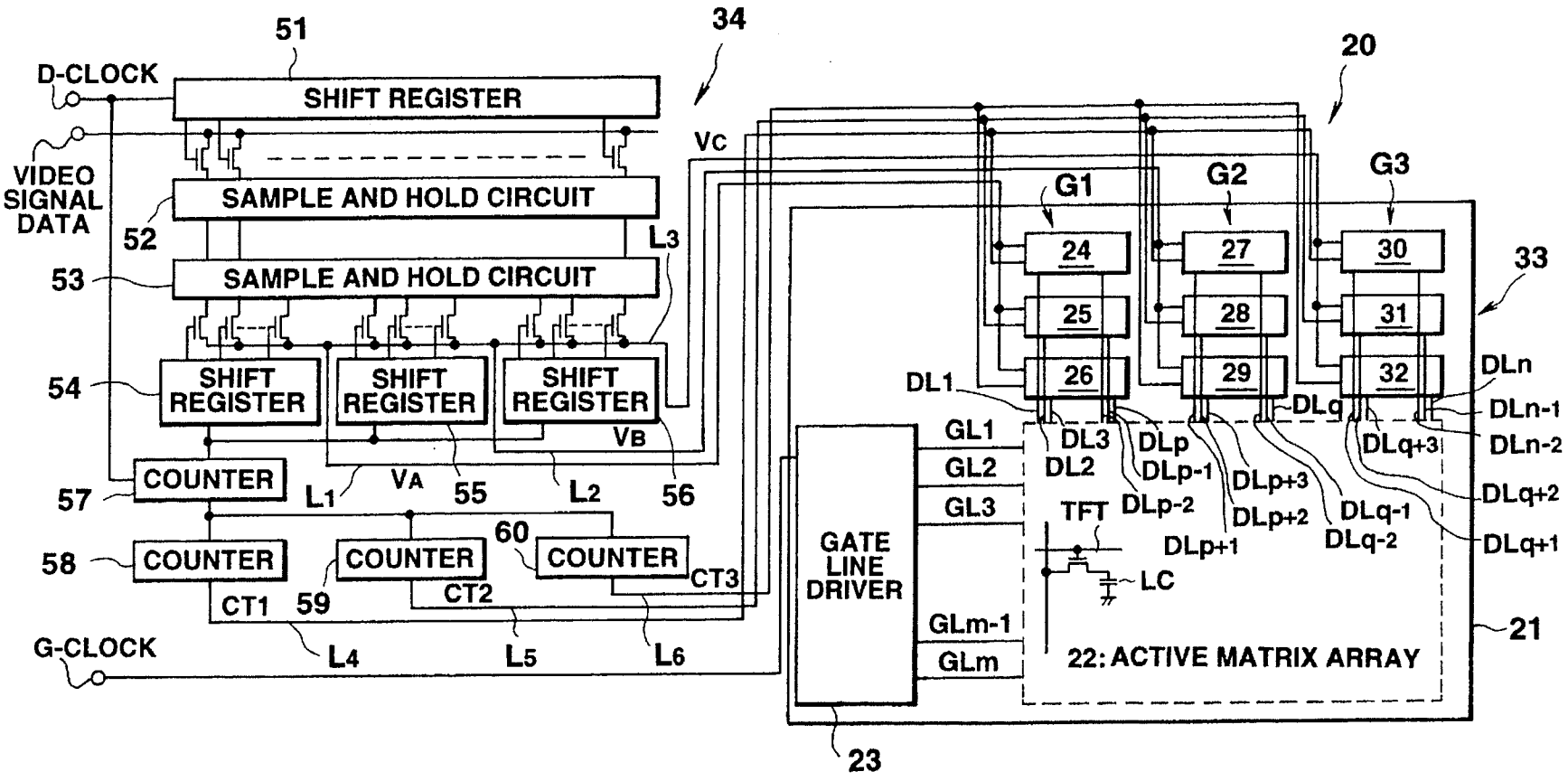
FIG. 2 is a circuit diagram showing a display driving apparatus according to a first embodiment of the present invention.
Figure 3:
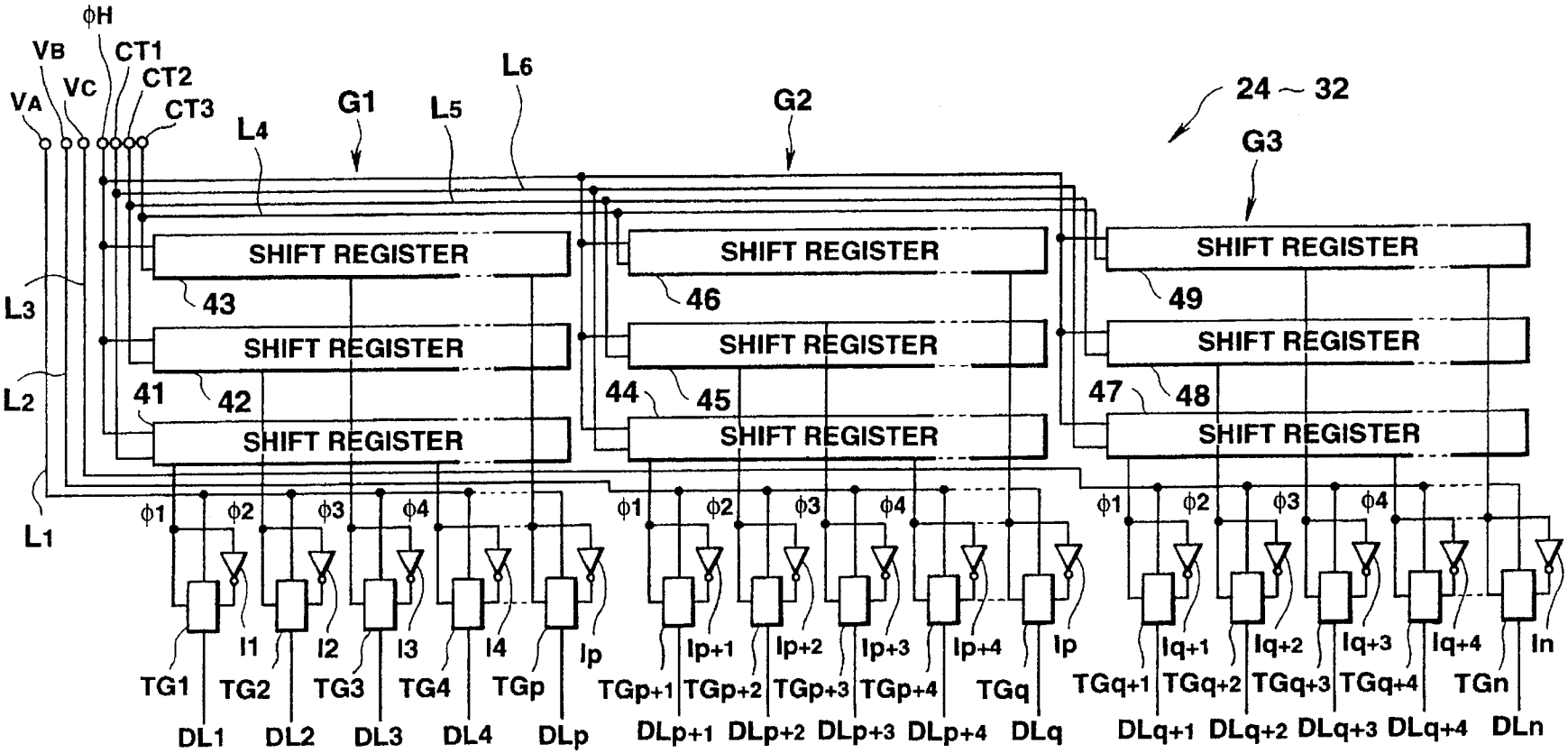
FIG. 3 is a circuit diagram showing a circuit configuration of a drain line driver according to the first embodiment of the present invention.
Figures 4, 4A, 4B, 4C, 4D, 4E, 4F, 4G, 4H, 4J, 4K, 4L, 4M:
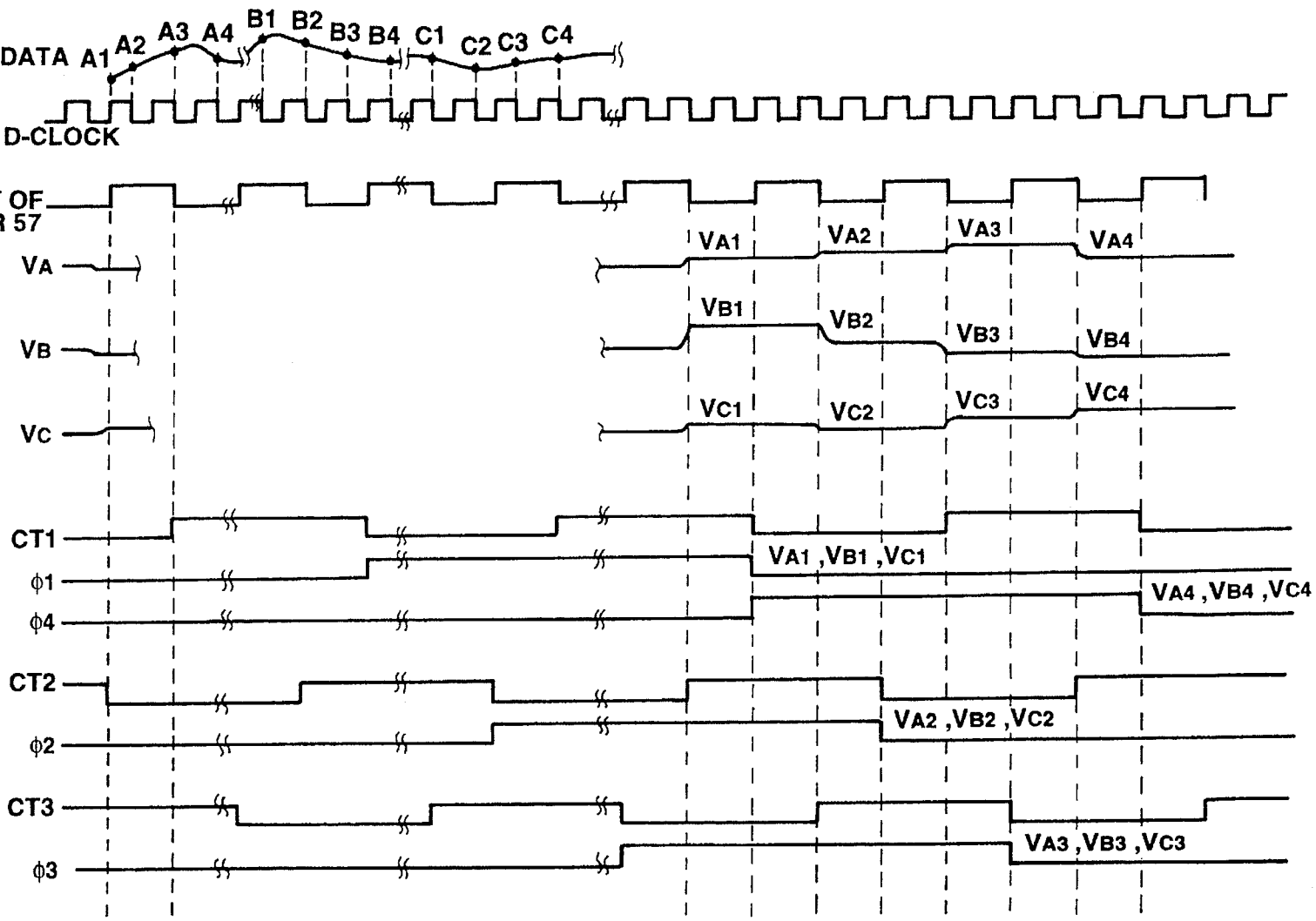

FIGS. 2 to 4 are circuit diagrams and timing charts for explaining a display driving apparatus according to the first embodiment of this invention.

In the first embodiment, this invention is applied to a display driving apparatus for a circuit-integrated type active matrix LC display panel. FIG. 2 is a circuit diagram showing this display driving apparatus.

In FIG. 2, a display driving apparatus 20 comprises a circuit-integrated type active matrix LC display panel 33, which has an active matrix array 22, a single gate line driver 23 as a scan side driver and nine drain line drivers 24, 25, 26, 27, 28, 29, 30, 31 and 32 as data side drivers all formed on a substrate 21, and an external circuit 34.

The active matrix array 22 has a plurality of gate lines GL1–GLm and a plurality of drain lines DL1–DLn formed in a matrix form on the substrate 21. Display elements each comprising a TFT as a switching element and a pixel LC are arranged in association with the individual intersections between the gate lines GL1–GLm and the drain lines DL1–DLn. FIG. 2 which shows only one of the display elements. In FIG. 2 the gate and drain of a TFT are connected to the vicinity of the intersection of one gate line GL and its associated drain line DL, with the pixel LC connected to the source of the TFT.

The scan side driver and the data side drivers formed on the substrate 21 comprise, for example, the same TFTs that comprise the display elements.

The individual gate lines GL1–GLm are connected to the gate line driver 23, which receives a G-clock signal from a controller (not shown). Based on the G-clock signal, the gate line driver 23 sequentially outputs gate signals to the individual gate lines GL1–GLm to sequentially select the gate lines GL1–GLm, thus turning on the TFTs connected to the selected gate lines GL1–GLm.

The data side driver section comprising the nine drain line drivers 24–32 formed on the substrate 21 is separated into three groups G1, G2 and G3 respectively consisting of the drain line drivers 24–26, the drain line drivers 27–29 and the drain line drivers 30–32. Each of the drain lines DL1–DLn is connected one of the three drain line drivers 24–26, 27–29 or 30–32 in the group G1, G2 or G3, so that the drain lines DL1–DLn are segmented to nine driving sections.

More specifically, the drain lines DL1–DLn are separated into three driving sections, drain lines DL1–DLp, data lines DLp+1–DLq and data lines DLq+1–DLn equal in number counting from the leftmost line in FIG. 2. The drain lines DL1–DLp, data lines DLp+1–DLq and data lines DLq+1–DLn in those driving sections are connected one to one to the associated drain line drivers 24–26 in the group G1, drain line drivers 27–29 in the group G2 and drain line drivers 30–32 in the group G3, so that each driving section is further divided into three sub driving sections.

The drain lines DL1–DLn are arranged in this embodiment in such a manner that given that the number of drain line drivers in the same group is S, the individual drain lines are connected to the same drain line driver with (S–1) drain lines, connected to other drain line drivers in the same group, in between.

More specifically, the drain line DL1 among the drain lines DL1–DLp is connected to the drain line driver 24 in the group G1 consisting of the drain line drivers 24–26, the drain line DL2 to the drain line driver 25, and the drain line DL3 to the drain line driver 26. Likewise, the next set of drain lines are respectively connected to the drain line drivers 24 to 26 in the group G1. Finally, the drain line DLp–2 is connected to the drain line driver 24, the drain line DLp–1 to the drain line driver 25, and the drain line DLp to the drain line driver 26. Likewise, the data lines DLp+1–DLq are connected to the associated drain line drivers 27–29 in the group G2, and the data lines DLq+1–DLn are connected to the associated drain line drivers 30–32 in the group G3.

As the drain lines DL1–DLn are connected one to one to the drain line drivers 24–26, 27–29 or 30–32 in the three group G1, G2 and G3, those drain lines DL1–DLn are separated into nine driving sections.

Thinned video signals $V_A$, $V_B$ and $V_C$, which will be discussed later, are input from the external circuit 34 to the drain line drivers 24–26 in the group G1, the drain line drivers 27–29 in the group G2 and the drain line drivers 30–32 in the group G3, group by group, via data signal lines $L_1$, $L_2$ and $L_3$. Further, a clock signal CT1 is input to the associated drain line drivers 24, 27 and 30 in the groups G1, G2 and G3 via a clock signal line $L_4$, a clock signal CT2 is input to the associated drain line drivers 25, 28 and 31 in the groups G1, G2 and G3 via a clock signal line $L_5$, and a clock signal CT3 is input to the associated drain line drivers 26, 29 and 32 in the groups G1, G2 and G3 via a clock signal line $L_6$.

The drain line drivers 24–32 have specific circuit structures as shown in FIG. 3.

Referring to FIG. 3, each of the drain line drivers 24–32 comprises three shift registers 41 to 43, 44 to 46 or 47 to 49, nine in total, transfer gates TG1 to TGp, TGp+1 to TGq or TGq+1 to TGn connected between the shift registers 41–43, 44–46 or 47–49 and the associated data lines DL1–DLn, and inverters I1 to Ip, Ip+1 to Iq or Iq+1 to In each connected to one control terminal of the associated one of the transfer gates TG1–TGp, TGp+1–TGq or TGq+1–TGn. A horizontal sync signal ϕH is input to the individual shift registers 41–49. The clock signal CT1 is input to the associated shift registers 41, 44 and 47 in the groups G1, G2 and G3, the clock signal CT2 is input to the associated shift registers 42, 45 and 48 and the clock signal CT3 is input to the associated shift registers 43, 46 and 48.

The transfer gates TG1–TGp, TGp+1–TGq or TGq+1–TGn respectively connected to the shift registers 41–43, 44–46 and 47–49 in the groups G1, G2 and G3 have their input terminals connected to the associated data signal lines $L_1$ to $L_3$, and their output terminals connected to the associated data lines DL1–DLn. The thinned video signals $V_A$, $V_B$ and $V_C$ to be discussed shortly are respectively input to the input terminals of those transfer gates TG1–TGp, TGp+1–TGq or TGq+1–TGn.

The individual shift registers 41–49 shift data, set based on the horizontal sync signal ϕH, by one bit in accordance with the falling of the associated clock signal CT1, CT2 or CT3, and send their outputs (bit data) as control signals ϕ1, ϕ2, ϕ3, . . . from the output terminals to the control terminals of the transfer gates TG1–TGp, TGp+1–TGq or TGq+1–TGn connected to those output terminals. The control signals ϕ1, ϕ2, and so forth are input directly to one control terminals of the transfer gates TG1–TGp, TGp+1–TGq and TGq+1–TGn and are input to the other control terminals after being inverted by the respective inverters I1–In. In response to the control signals from the associated shift registers 41–49, the transfer gates TG1–TGp, TGp+1–TGq or TGq+1–TGn are enabled to supply the thinned video signals $V_A$, $V_B$ and $V_C$ input then onto the associated data lines DL1–DLn.

Referring to FIG. 2, the external circuit 34 comprises a shift register 51, sample and hold circuits 52 and 53, three shift registers 54, 55 and 56, and four counters 57, 58, 59 and 60. The a shift register 51, sample and hold circuits 52 and 53, three shift registers 54, 55 and 56 and counter 57 constitute a data signal generator. The counters 57, 58, 59 and 60 constitute a clock signal generator. An analog video signal is input to the sample and hold circuit 52, and the D-clock signal is input to the shift register 51 and the counter 57 from the controller (not shown).

In synchronism with the D-clock signal, the shift register 51 causes the sample and hold circuit 52 to sample and hold the input analog video signal DATA. When the scanning of the next scan line starts, the video signals written in the sample and hold circuit 52 are transferred to the sample and hold circuit 53, for example, in response to a horizontal sync signal ϕH. The thinned video signals written in this sample and hold circuit 53 are divided to one third of one scan line each by the shift registers 54, 55 and 56 which transfer drive signals in synchronism with the output signal of the counter 57, and the divided video signals are output in parallel to the drain line drivers 24–26, 27–29 and 30–32 of the groups G1, G2 and G3 as thinned video signal data $V_A$, $V_B$ and $V_C$.

FIGS. 4A through 4M, which are timing charts for explaining the operation of the first embodiment, should be referred to in the following description.

The counter 57 frequency-divides the D-clock signal shown in FIG. 4B to one third, and respectively outputs the resultant signals to the shift registers 54–56 and the counters 58–60 as a transfer signal and a counting signal, as shown in FIG. 4C.

The counters 58, 59 and 60 further frequency-divide the received ⅓-frequency-divided D-clock signals to one third, yielding ⅓-frequency-divided clock signals, and respectively send the resultant signals as the clock signals CT1, CT2 and CT3 with phases 120 degrees shifted from one another, as shown in FIGS. 4G, 4I, 4L, to the drain line drivers 24, 27 and 30, drain line drivers 25, 28 and 31, and drain line drivers 26, 39 and 32 at the associated positions in the groups G1, G2 and G3. Therefore, the clock signals CT1, CT2 and CT3 having one ninth the frequency of the D-clock signal are applied to the drain line drivers 24, 27 and 30, drain line drivers 25, 28 and 31, and drain line drivers 26, 29 and 32 at the associated positions in the groups G1, G2 and G3.

The shift register 51 causes video signals DATA to be sequentially written and held in the sample and hold circuit 52 in synchronism with the D-clock signal as shown in FIGS. 4A and 4B. When the scanning of the next gate line starts, the video signals DATA written in the sample and hold circuit 52 are transferred to the sample and hold circuit 53. As mentioned above, the display driving apparatus 20 comprises the substrate 21, the active matrix array 22 formed on the substrate 21, the gate line driver 23 and the nine drain line drivers 24–32. The individual data lines DL1–DLn of the active matrix array 22 are connected in order to the drain line drivers 24–26, the drain line drivers 27–29 and the drain line drivers 30–32 in the groups G1, G2 and G3 each consisting of three drain line drivers, so that those data lines are separated into nine driving sections. The first thinned video signals $V_A$ shown in FIG. 4D, obtained by trisecting one horizontal scan line of analog video signals, are commonly input to the drain line drivers 24–26 in the group G1. The second thinned video signals $V_B$ shown in FIG. 4E, another trisected analog video signals, are likewise commonly input to the drain line drivers 27–29 in the group G2. Further, the third thinned video signals $V_C$ shown in FIG. 4F, another trisected analog video signals, are commonly input to the drain line drivers 30–32 in the group G3.

The clock signal CT1 output from the counter 58 is commonly input to the drain line drivers 24, 27 and 30 at the associated positions in the groups G1, G2 and G3, the clock signal CT2 output from the counter 59 is commonly input to the associated drain line drivers 25, 28 and 31 and the clock signal CT3 output from the counter 60 is commonly input to the associated drain line drivers 26, 29 and 32.

Those clock signals CT1, CT2 and CT3 are obtained by frequency-dividing the D-clock signal to one third by the counter 57 of the external circuit 34, further frequency-dividing the resultant signals to one third by the counters 58, 59 and 60, and shifting their phases by 120 degrees.

The operation of the group G1 consisting of the drain line drivers 24–26 will be discussed first.

The thinned video signals $V_A$ of analog video signals DATA having data A1, A2, A3, . . . for the first ⅓ period of each horizontal scanning period are held in the sample and hold circuit 53, and thinned video signals $V_A$ consisting of thinned data $V_{A1}$, $V_{A2}$, $V_{A3}$, . . . corresponding to the held signals are transferred to the drain line drivers 24, 25 and 26 in synchronism with the output signal of the counter 57. The first video signal $V_{A1}$ among the thinned video signals $V_A$ transferred to the drain line driver 24 is supplied via the transfer gates TG1 to the data line DL1 when the control signal $\phi 1$ becomes an H level in response to the falling of the clock signal CT1 which is the D-clock signal frequency-divided to one ninth as shown in FIGS. 4G and 4H. In response to next falling of the clock signal CT1, the data in the shift register 41 is shifted by one bit and the control signals $\phi 1$ and $\phi 4$ become an L level and H level, respectively, as shown in FIGS. 4G, 4H, and 4I, closing the transfer gates TG1 and opening the transfer gate TG4. The video signal $V_{A1}$ which has been applied immediately before closing of the transfer gates TG1 is held in the pixel capacitor LC and the floating capacitor of the data line DL1.

Next, the second video signal $V_{A2}$ among the thinned video signals $V_A$ transferred to the drain line driver 25 is supplied to the data line DL2 via the transfer gates TG2, which is opened when the control signal $\phi 2$ became an H level, in response to the clock signal CT2 which is the D-clock signal frequency-divided to one ninth and has a phase delay of 120 degrees from the clock signal CT1, as shown in FIGS. 4J and 4K. When the clock signal CT2 falls next, the control signal $\phi 2$ becomes an L level, as shown in FIGS. 4J and 4K, closing the transfer gates TG2. Consequently, the video signal $V_{A2}$ which has been applied when the transfer gates TG2 has been closed, is held in the pixel capacitor LC and the floating capacitor of the data line DL2.

The third video signal $V_{A3}$ among the thinned video signals $V_A$ transferred to the drain line driver 26 is supplied to the data line DL3 via the transfer gates TG3, which were opened when the control signal $\phi 3$ became an H level, in response to the clock signal CT3 which is the D-clock signal frequency-divided to one ninth and has a phase delay of 120 degrees from the clock signal CT2, as shown in FIGS. 4L and 4M. When the clock signal CT3 falls next, the control signal $\phi 3$ becomes an L level, as shown in FIGS. 4L and 4M, closing the transfer gates TG3. Consequently, the video signal $V_{A3}$ is held in the pixel capacitor LC and the floating capacitor of the data line DL3.

In this manner, the drain line driver 24 supplies the thinned video signals $V_A$ to the data lines DL1, DL4, . . . , DLp–2 in response to the clock signal CT1 which is the D-clock signal frequency-divided to one ninth. The drain line driver 25 supplies the thinned video signals $V_A$ to the data lines DL2, DL5, . . . , DLp–1 in response to the clock signal CT2 which is the D-clock signal frequency-divided to one ninth and has a phase delay of 120 degrees from the clock signal CT1. The drain line driver 26 supplies the thinned video signals $V_A$ to the data lines DL3, DL6, . . . , DLp in response to the clock signal CT3 which is the D-clock signal frequency-divided to one ninth and has a phase delay of 120 degrees from the clock signal CT2. The video signals $V_A$ supplied to each data line DL is held by the capacitor between that data line DL and the substrate 21 and the pixel capacitor LC, and is held in the pixel capacitor LC after the associated TFT in the active matrix array 22 is turned off, in response to turning off of the gate pulse.

The same operation is performed for the group G2 consisting of the drain line drivers 27–29 and the group G3 consisting of the drain line drivers 30–32.

For the group G2, the drain line driver 27 supplies the thinned video signals $V_B$ to the data lines DLp+1, DLp+4, . . . , DLq–2 in response to the clock signal CT1. The drain line driver 28 supplies the thinned video signals $V_B$ to the data lines DLp+2, DLp+5, . . . , DLq–1 in response to the clock signal CT2 having a phase delay of 120 degrees from the clock signal CT1. The drain line driver 29 supplies the thinned video signals $V_B$ to the data lines DLp+3, DLp+6, . . . , DLq in response to the clock signal CT3 having a phase delay of 120 degrees from the clock signal CT2.

With regard to the group G3, the drain line driver 30 supplies the thinned video signals $V_C$ to the data lines DLq+1, DLq+4, . . . , DLn–2 in response to the clock signal CT1. The drain line driver 31 supplies the thinned video signals $V_C$ to the data lines DLq+2, DLq+5, . . . , DLn—1 in response to the clock signal CT2 having a phase delay of 120 degrees from the clock signal CT1. The drain line driver 32 supplies the thinned video signals $V_C$ to the data lines DLq+3, DLq+6, . . . , DLn in response to the clock signal CT3 having a phase delay of 120 degrees from the clock signal CT2.

As mentioned above, the drain line drivers 24, 27 and 30 are driven by the common clock signal CT1. Therefore, the thinned video signals $V_{A1}$, $V_{B1}$ and $V_{C1}$ are supplied to the respective data lines DL1, DLp+1 and DLq+1 and held in the respective pixel capacitors LC in the same scanning period, as shown in FIG. 4H. Likewise, the drain line drivers 25, 28 and 31 are driven by the common clock signal CT2. Therefore, the thinned video signals $V_{A2}$, $V_{B2}$ and $V_{C2}$ are supplied to the respective data lines DL2, DLp+2 and DLq+2 and held in the respective pixel capacitors LC in the same scanning period, as shown in FIG. 4K. Further, the drain line drivers 26, 29 and 32 are driven by the common clock signal CT3. Therefore, the thinned video signals $V_{A3}$, $V_{B3}$ and $V_{C3}$ are supplied to the respective data lines DL3, DLp+3 and DLq+3 and held in the respective pixel capacitors LC in the same scanning period, as shown in FIG. 4M.

A gate pulse turns on, for example, before the control signal $\phi$1 turns on, and turns off after last thinned video signals are supplied to the respective data lines and held in the respective pixel capacitors.

As described above, the LC display panel of this embodiment comprises the substrate 21, the active matrix array 22, and the drain line drivers 24–32 both formed on this substrate 21. The drain line drivers 24–32 are separated into a plurality of groups G1, G2 and G3 each consisting of the same number of drain line drivers. That is, the group G1 consists of the drain line drivers 24–26, the group G2 consists of the drain line drivers 27–29 and the group G3 consists of the drain line drivers 30–32. The thinned video signals $V_A$, $V_B$ and $V_C$ are respectively input to the drain line drivers 24–26 in the group G1, the drain line drivers 27–29 in the group G2 and the drain line drivers 30–32 in the group G3.

The individual data lines DL1–DLn are connected one to one to the drain line drivers 24–26, the drain line drivers 27–29 and the drain line drivers 30–32. Therefore, the data lines DL1–DLn are separated into the driving sections equal in number (3) to the groups G1, G2 and G3. The associated sets of the drain line drivers 24–26, the drain line drivers 27–29 and the drain line drivers 30–32 in the groups G1, G2 and namely, the drain line drivers 24, 27 and 30, the drain line drivers 25, 28 and 31, and the drain line drivers 26, 29 and 32, are connected by their common clock signal lines. The drain line drivers 24–26, the drain line drivers 27–29 or the drain line drivers 30–32 in the group G1, G2 or G3 are respectively driven by the clock signals CT1, CT2 and CT3 whose phases are shifted from one another by the angle corresponding to the number of the drain line drivers constituting each group G1, G2 or G3 (three drivers in this embodiment).

Accordingly, the frequency of the clock signals CT1, CT2 and CT3 can be reduced in inverse proportion to the product of the number of the groups of the data side driver section (the number of the driving sections) and the number of the drain line drivers constituting each group. Even if slow switching elements, such as polysilicon-based TFTs, are used for the drivers, therefore, it is possible to ensure a sufficient driving speed to cope with display panels having high definition and large screen. Accordingly, even display panels having high-pixel capacitance, such as HDTVs can provide high-quality images.

A display driving apparatus according to the second embodiment of this invention will be described with reference to the circuit diagram of FIG. 5 and the timing charts of FIGS. 6A to 6I.

Figure 5:
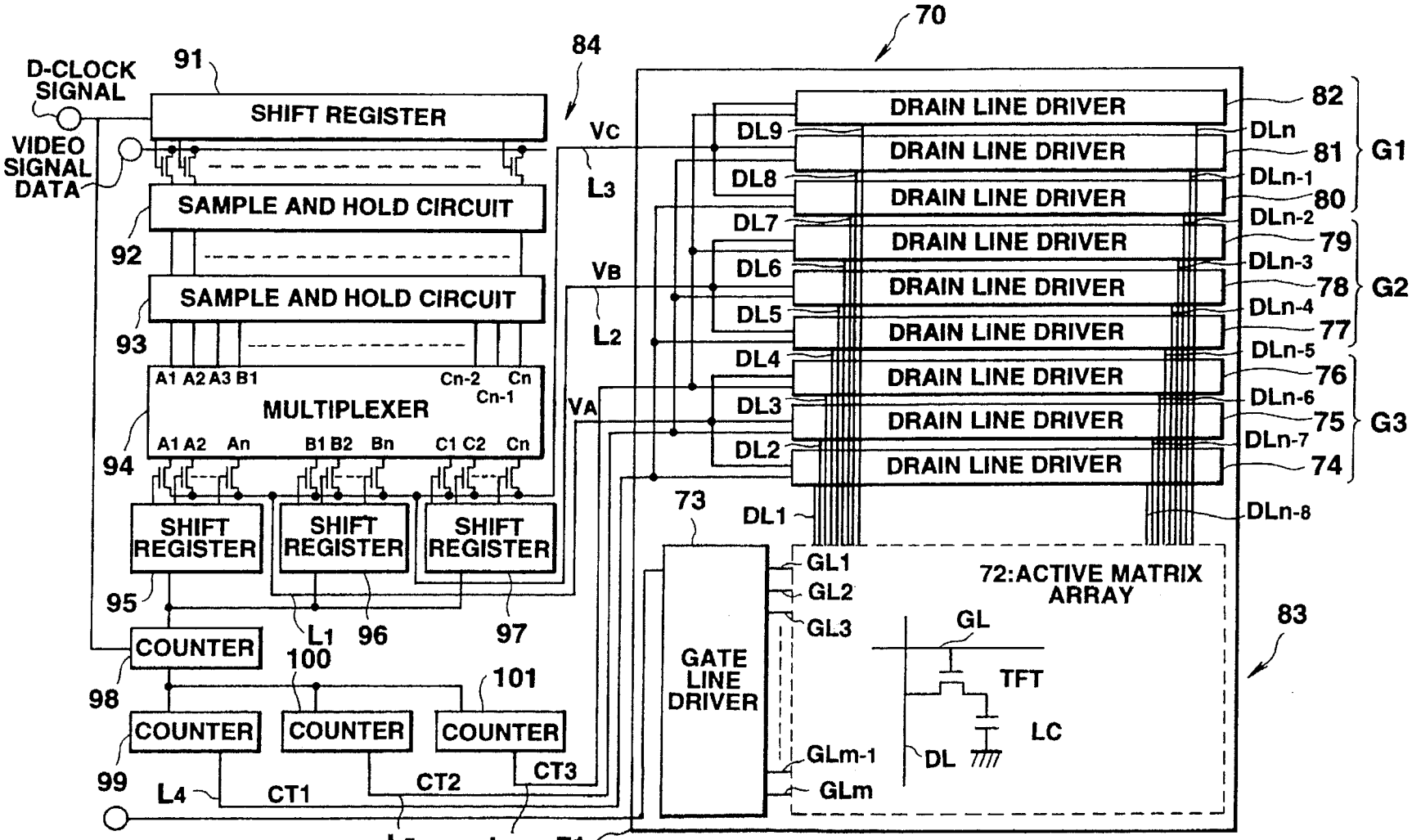
FIG. 5 is a circuit diagram showing a display driving apparatus according to a second embodiment of this invention.

In FIG. 5, a display driving apparatus 70 comprises a circuit-integrated type active matrix LC display panel 83, which has a substrate 71, an active matrix array 72, a single gate line driver 73 and nine drain line drivers 74, 75, 76, 77, 78, 79, 30, 81 and 82 all formed on the substrate 71, and an external circuit 84.

The active matrix array 72 has a plurality of gate lines GL1–GLm and a plurality of drain lines DL1–DLn formed in a matrix form on the substrate 71. Display elements each consisting of a TFT as a switching element and a pixel LC are arranged at the individual intersections between the gate lines GL1–GLm and the drain lines DL1–DLn. In FIG. 5 which shows only one of the display elements, the gate and drain of a TFT are connected to the vicinity of the intersection of one gate line GL and its associated drain line DL, with the pixel LC connected to the gate of the TFT.

The individual gate lines GL1–GLm are connected to the gate line driver 73, which receives a G-clock signal from a controller (not shown).

Based on the G-clock signal, the gate line driver 73 sequentially outputs gate signals to the individual gate lines GL1–GLm to selectively scan the gate lines GL1–GLm one by one, thus turning on the TFTs connected to the selected gate lines GL1–GLm.

The video signals to be input to the drain line drivers 74–82 are separated into groups as will be discussed later. Therefore, the data side driver section comprising the nine drain line drivers 74–82 formed on the substrate 71 are separated into three groups G1, G2 and G3 respectively consisting of the drain line drivers 74–76, the drain line drivers 77–79 and the drain line drivers 80–82. Each of the drain lines DL1–DLn is connected to one of the individual drain line drivers 74–76, 77–79 or 80–82 in the group G1, G2 or G3, so that the drain lines DL1–DLn are segmented to nine driving sections.

The drain lines DL1–DLn are arranged in this embodiment in such a manner that given that the number of the groups is r and the number of drain line drivers in the same group is S, the individual drain lines are connected to the same drain line driver with (r·S−1) drain lines DL1–DLn, connected to other drain line drivers, in between.

More specifically, as shown in FIG. 5, the drain lines DL1–DLn are connected one to one to the drain line driver 74, close to the active matrix array 72, to the drain line driver 82, repeatedly.

That is, the drain lines DL1–DL3 are respectively connected to the drain line drivers 74–76 in the group G1, the drain lines DL4–DL6 are respectively connected to the drain line drivers 77–79 in the group G2, the drain lines DL7–DL9 are respectively connected to the drain line drivers 80–82 in the group G3, and the remaining drain lines DL10–DLn are likewise connected to those drain line drivers.

Thinned video signals $V_A$, $V_B$ and $V_C$ are input from the external circuit 84 to the drain line drivers 74–76 in the group G1, the drain line drivers 77–79 in the group G2 and the drain line drivers 80–82 in the group G3, group by group. Further, a clock signal CT1 is input to the associated drain line drivers 74, 77 and 80 in the groups G1, G2 and G3, a clock signal CT2 is input to the associated drain line drivers 75, 78 and 81 in the groups G1, G2 and G3, and a clock signal CT3 is input to the associated drain line drivers 76, 79 and 82 in the groups G1, G2 and G3.

Though not illustrated, each of the drain line drivers 74–82 comprises three shift registers, nine in total, transfer gates connected between the shift registers and the associated data lines DL1–DLn, and inverters each connected to one control terminal of the associated one of the transfer gates, as per the first embodiment. A horizontal sync signal is input to the individual shift registers from a display controller (not shown). The clock signals CT1, CT2 and CT3 are respectively input to the shift registers of the associated drain line drivers 74–82 in the groups G1, G2 and G3.

The control terminals of the transfer gates are respectively connected to the shift registers of the associated drain line drivers 74–82 in the groups G1, G2 and G3, as per the first embodiment. The serial thinned video signals $V_A$, $V_B$ and $V_C$ are respectively input to the input terminals of those transfer gates whose output terminals are connected to the associated drain lines DL1–DLn.

The shift registers of the individual drain line drivers 74–82 shift bit data, set based on the horizontal sync signal, in response to the associated clock signals CT1, CT2 and CT3, and send their outputs as control signals from the output terminals. Those output control signals are input directly to one control terminals of the transfer gates and are input to the other control terminals after being inverted by the respective inverters. In response to the control signals from the associated shift registers, the transfer gates are enabled to supply the serial thinned video signals $V_A$, $V_B$ and $V_C$ input then onto the associated drain lines DL1–DLn.

Referring to FIG. 5, the external circuit 84 comprises a shift register 91, sample and hold circuits 92 and 93, a multiplexer 94, three shift registers 95, 96 and 97, four counters 98, 99, 100 and 101.

An analog video signal DATA is input to the sample and hold circuit 92, and the D-clock signal is input to the shift register 91 and the counter 98 from the controller (not shown).

In synchronism with the D-clock signal, the shift register 91 causes the sample and hold circuit 92 sequentially samples and holds the input analog video signal DATA. When the scanning of the next scan line starts, the video signals written in the sample and hold circuit 92 are transferred to the sample and hold circuit 93.

The thinned video signals written in the sample and hold circuit 93 are output to the multiplexer 94 which in turn sequentially outputs the received thinned video signals to the shift registers 95, 96 and 97 in a predetermined order.

The shift registers 95, 96 and 97 divide the thinned video signals output from the multiplexer 94 one third of one scan line in a predetermined order, based on the ⅓-frequency-divided clock from the counter 98. The trisected signals are output as serial thinned video data $V_A$, $V_B$ and $V_C$ to the drain line drivers 74–76, 77–79 and 80–82 in the groups G1, G2 and G3 in parallel.

Figures 6A, 6B, 6C, 6D, 6E, 6F, 6G, 6H, 6I:
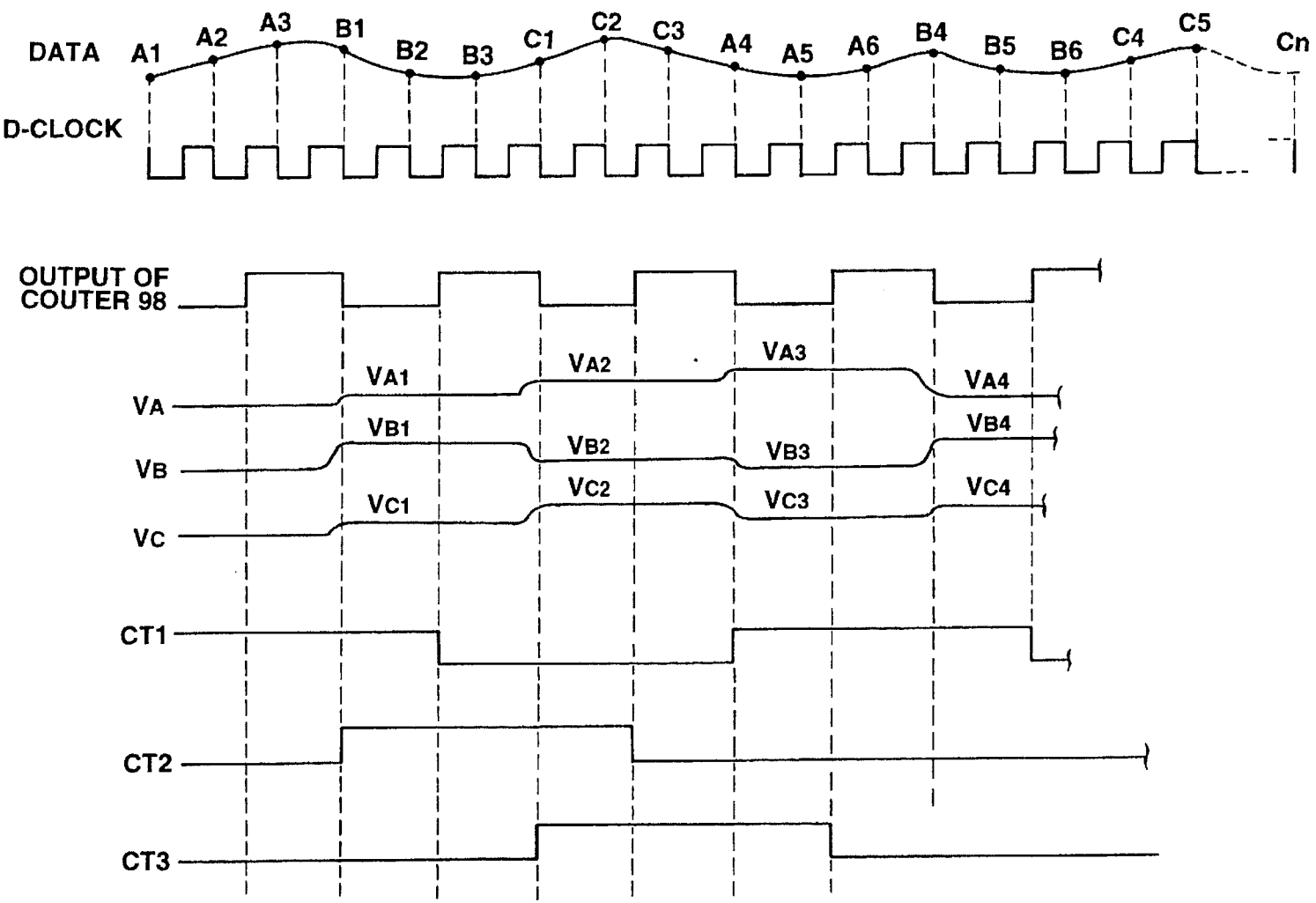
FIGS. 6A through 6I are timing charts respectively showing an analog video signal, a D-clock signal, the output of a counter 98, thinned video signals $V_A$, $V_B$ and $V_C$, and clock signals CT1, CT2 and CT3 in the second embodiment.

More specifically, the sample and hold circuit 94 samples and holds the data A1, A2, A3, B1, B2, B3, C1, C2, C3, A4, A5, A6, . . . shown in FIG. 6A as thinned video signals in response to the falling of the D-clock signal shown in FIG. 6B. After being sent to the sample and hold circuit 93 in the next scanning period, the thinned video signals are supplied to the multiplexer 94.

The multiplexer 94 rearranges the thinned video signals A1, A2, A3, B1, B2, B3, C1, C2, C3, A4, A5, A6, . . . to A1, A2, A3, A4, A5 . . . , An, B1, B2, B3 . . . , Bn and C1, C2, C3, . . . , Cn, and outputs the rearranged video signals. Therefore, the multiplexer 94 outputs the first sampled three thinned video signals A1, A2 and A3 and three consecutive thinned video signals starting from every ninth one thereafter, as serial thinned video data $V_{A1}$, $V_{A2}$, $V_{A3}$, $V_{A4}$, $V_{A5}$, $V_{A6}$, . . . to the drain line drivers 74–76 in the group G1.

The aforementioned one scan line of thinned video signal are output by the shift register 96 as the fourth to sixth sampled thinned video signals B1, B2 and B3 and three consecutive thinned video signals starting from every ninth one thereafter, as serial thinned video data $V_{B1}$, $V_{B2}$, $V_{B3}$, $V_{B4}$, $V_{B5}$, $V_{B6}$, . . . to the drain line drivers 77–79 in the group G2.

Further, the aforementioned one scan line of thinned video signals are output by the shift register 97 as the seventh to ninth sampled thinned video signals C1, C2 and C3 and three consecutive thinned video signals starting from every seventh one thereafter, as serial thinned video data $V_{C1}$, $V_{C2}$, $V_{C3}$, $V_{C4}$, $V_{C5}$, $V_{C6}$, . . . to the drain line drivers 80–82 in the group G3.

FIGS. 6A through 6I are timing charts illustrating the timings for the video signals and the individual clock signals.

The counter 98 frequency-divides the input D-clock signal to one third as shown in FIGS. 6B and 6C, and respectively outputs the resultant signals to the shift registers 95–97 and the counters 99–101 as ⅓-frequency-divided clocks.

As described above, the shift registers 95–97 separate the thinned video signals output from the multiplexer 94 to one third of one scan line in the aforementioned order and output the resultant signals in parallel as serial thinned video data $V_A$, $V_B$ and $V_C$ shown in FIGS. 6D, 6E, and 6F to the drain line drivers 74–76, 77–79 and 80–82 in the groups G1, G2 and G3.

The counters 99, 100 and 101 further frequency-divide the received ⅓-frequency-divided D-clock signals (⅓-frequency-divided clocks) to one third, yielding ⅑-frequency-divided clock signals, and respectively send the resultant signals as the clock signals CT1, CT2 and CT3 with phases 120 degrees shifted from one another, as shown in FIGS. 6G to 6I, to the drain line drivers 74, 77 and 80, drain line drivers 75, 78 and 81, and drain line drivers 76, 79 and 82 at the associated positions in the groups G1, G2 and G3.

Therefore, the clock signals CT1, CT2 and CT3 having one ninth the frequency of the D-clock signal are applied in parallel to the drain line drivers 74, 77 and 80, drain line drivers 75, 78 and 81, and drain line drivers 76, 79 and 82 at the associated positions in the groups G1, G2 and The operation of this embodiment will be described below.

The display driving apparatus 70 has the substrate 71, the active matrix array 72, the gate line driver 73 and the nine drain line drivers 74–82 all formed on the substrate 71, as mentioned earlier. The individual data lines DL1–DLn of the active matrix array 72 are connected one to one to the drain line drivers 74–76, the drain line drivers 77–79 and the drain line drivers 80–82 every three drivers constituting one group, so that the data lines DL1–DLn are separated into nine driving sections.

The serial thinned video signals $V_A$ shown in FIG. 6D, which consists of the first sampled consecutive thinned video signals among the analog video signals DATA and every three consecutive thinned video signals sampled starting from every ninth one thereafter, are commonly input to the drain line drivers 74–76 in the group G1. Likewise, the serial thinned video signals $V_B$ shown in FIG. 6E, which consists of the fourth to sixth sampled consecutive thinned video signals among the analog video signals DATA and every three consecutive thinned video signals sampled starting from every ninth one thereafter, are commonly input to the drain line drivers 77–79 in the group G2. Further, the serial thinned video signals $V_C$ shown in FIG. 6F, which consists of the seventh to ninth sampled consecutive thinned video signals among the analog video signals DATA and every three consecutive thinned video signals sampled starting from every ninth one thereafter, are commonly input to the drain line drivers 80–82 in the group G3.

The clock signal CT1 output from the counter 99 is commonly input to the drain line drivers 74, 77 and 80 at the associated positions in the groups G1, G2 and G3, the clock signal CT2 output from the counter 90 is commonly input to the associated drain line drivers 75, 78 and 81 and the clock signal CT3 output from the counter 81 is commonly input to the associated drain line drivers 76, 79 and 82.

Those clock signals CT1, CT2 and CT3 are obtained by frequency-dividing the D-clock signal to one third by the counter 98, further frequency-dividing the resultant signals to one third by the counters 99, 100 and 101, and shifting their phases by 120 degrees.

One scan line of thinned video signals consisting of signals A1, A2, A3, B1, B2, B3, C1, C2, C3, . . . are held and sampled in the sample and hold circuit 92. The sampled video signals are then supplied to the multiplexer 94. The multiplexer 94 rearranges the received video signals to A1–An, B1–Bn, C1–Cn. Every ninth output of the multiplexer 94 is selected by the shift registers 95, 96 and 97, and the resultant video signals are transferred as the serial thinned video data $V_{A1}$, $V_{A2}$, $V_{A3}$; $V_{B1}$, $V_{B2}$, $V_{B3}$; $V_{C1}$, $V_{C2}$, $V_{C3}$; and so forth to the drain line drivers 74–76 in the group G1; the drain line drivers 77–79 in the group G2; and the drain line drivers 80–82 in the group G3 in synchronism with the output signal of the counter 98.

Let us now consider the group G1 consisting of the drain line drivers 74–76. The first video signal $V_{A1}$ among the serial thinned video signals $V_A$ transferred to the drain line driver 74 is supplied to the data line DL1 via the transfer gate which opens and closes in synchronism with the falling of the clock signal CT1, which is the D-clock signal frequency-divided to one ninth.

Next, the second video signal $V_{A2}$ among the thinned video signals $V_A$ transferred to the drain line driver 75 is supplied to the drain line DL2 via the transfer gate, which opens and closes in synchronism with the falling of the clock signal CT2 which is the D-clock signal frequency-divided to one ninth and has a phase delay of 120 degrees from the clock signal CT1.

The third video signal $V_{A3}$ among the thinned video signals $V_A$ transferred to the drain line driver 76 is supplied to the drain line DL3 via the transfer gate, which opens and closes in synchronism with the falling of the clock signal CT3 which is the D-clock signal frequency-divided to one ninth and has a phase delay of 120 degrees from the clock signal CT2.

In this manner, the drain line driver 24 supplies the signals $V_{A1}$, $V_{A4}$, . . . among the thinned video signals $V_A$ to the drain lines DL1, DL10, . . . , DLn–8 in response to the clock signal CT1 which is the D-clock signal frequency-divided to one ninth. The drain line driver 75 supplies the thinned video signals $V_{A2}$, $V_{A5}$, . . . to the drain lines DL2, DL11, . . . , DLn–7 in response to the clock signal CT2 which has a phase delay of 120 degrees from the clock signal CT1. Further, the drain line driver 76 supplies the thinned video signals $V_{A3}$, $V_6$, . . . to the drain lines DL3, DL12, . . . , DLn–6 in response to the clock signal CT3 which has a phase delay of 120 degrees from the clock signal CT2.

The video signals $V_A$ supplied to each drain line DL are held by the capacitor between that drain line DL and the substrate 71, and pixel capacitor LC, and are maintained in the pixel capacitor LC after the associated TFT in the active matrix array 72 is turned off.

The same operation is performed for the group G2 consisting of the drain line drivers 77–79 and the group G3 consisting of the drain line drivers 80–82.

As regards the group G2, the drain line driver 77 supplies the thinned video signals $V_{B1}$, $V_{B4}$ and so forth to the drain lines DL4, DL13, . . . , DLn–5 in response to the clock signal CT1 which is the D-clock signal frequency-divided to one ninth. The drain line driver 78 supplies the thinned video signals $V_{B2}$, $V_{B5}$ and so forth to the drain lines DL5, DL14, . . . , DLn–4 in response to the clock signal CT2 having a phase delay of 120 degrees from the clock signal CT1. The drain line driver 79 supplies the thinned video signals $V_{B3}$, $V_{B6}$ and so forth to the drain lines DL6, DL15, . . . , DLn–3 in response to the clock signal CT3 having a phase delay of 120 degrees from the clock signal CT2.

With regard to the group G3, the drain line driver 80 supplies the thinned video signals $V_{C1}$, $V_{C4}$ and so forth to the drain lines DL7, DL16, . . . , DLn–2 in response to the clock signal CT1. The drain line driver 81 supplies the thinned video signals $V_{C2}$, $V_{C5}$ and so forth to the drain lines DL8, DL17, . . . , DLn–1 in response to the clock signal CT2 having a phase delay of 120 degrees from the clock signal CT1. The drain line driver 82 supplies the thinned video signals $V_{C3}$, $V_{C6}$ and so forth to the drain lines DL9, DL18, . . . , DLn in response to the clock signal CT3 having a phase delay of 120 degrees from the clock signal CT2.

The drain line drivers 74, 77 and 80 are driven by the common clock signal CT1. Therefore, the thinned video signals $V_{A1}$, $V_{B1}$ and $V_{C1}$ are simultaneously supplied to the respective drain lines DL1, DL4 and DL7.

Likewise, the drain line drivers 75, 78 and 81 are driven by the common clock signal CT2. Therefore, the thinned video signal components $V_{A2}$, $V_{B2}$ and $V_{C2}$ are simultaneously supplied to the respective drain lines DL2, DL5 and DL8.

Further, the drain line drivers 76, 79 and 82 are driven by the common clock signal CT3. Therefore, the thinned video signal components $V_{A3}$, $V_{B3}$ and $V_{C3}$ are simultaneously supplied to the respective drain lines DL3, DL6 and DL9.

As described above, the display driving apparatus 70 comprises the substrate 71, the active matrix array 72 and the drain line drivers 74–82 both formed on this substrate 71. The drain line drivers 74–82 are separated into a plurality of groups G1, G2 and G3 each consisting of the same number of drain line drivers. That is, the group G1 consists of the drain line drivers 74–76, the group G2 consists of the drain line drivers 77–79 and the group G3 consists of the drain line drivers 80–82. The serial thinned video signals $V_A$, $V_B$ and $V_C$ are respectively input to the drain line drivers 74–76 in the group G1, the drain line drivers 77–79 in the group G2 and the drain line drivers 80–82 in the group G3.

The individual drain lines DL1–DLn are connected one to one to the drain line drivers 74–76, the drain line drivers 77–79 and the drain line drivers 80–82, and are thus separated into the driving sections equal in number (9) to those drain line drivers.

The associated sets of the drain line drivers 74–76, the drain line drivers 77–79 and the drain line drivers 80–82 in the groups G1, G2 and G3, namely, the drain line drivers 74, 77 and 80, the drain line drivers 75, 78 and 81, and the drain line drivers 76, 79 and 82, are connected by their common clock signal lines. The drain line drivers 74–76, the drain line drivers 77–79 or the drain line drivers 80–82 in the group G1, G2 or G3 are respectively driven by the clock signals CT1, CT2 and CT3 whose phases are shifted from one another by the angle corresponding to the number of the drain line drivers constituting each group G1, G2 or G3 ($360\times1/3=120$ degrees because of three drain line drivers in each group in this embodiment).

Accordingly, the frequency of the clock signals CT1, CT2 and CT3 can be reduced in inverse proportion to the product of the number of the driving sections and the number of the drain line drivers constituting each driving section. Even if slow switching elements, such as polysilicon-based TFTs, are used, therefore, it is possible to ensure a sufficient driving speed to cope with display panels having high definition and large screen.

Accordingly, even display panels having high-pixel capacitance, such as HDTVs can provide high-quality images.

According to this embodiment, the clock signals to be supplied to the drain line drivers 74–82 are obtained by frequency-dividing the D-clock signal to one third by the counter 98, shifting their phases from one another by 120 degrees, and then further frequency-dividing the resultant signals to one third by the counters 99, 100 and 101. The clock signals to be supplied to the individual drain line drivers 74–82 can therefore be generated with a simple circuit.

Although the groups G1, G2 and G3 consist of the same number of drain line drivers in the second embodiment, not all the groups should consist of the same number of drain line drivers. For example, the group at the final stage may consist of drain line drivers different in number from those of the other groups.

The first and second embodiments have been described with reference to the case where the drain line drivers 24–32 or 74–82 are separated into three groups G1, G2 and G3, which respectively consist of the drain line drivers 24–76 or 74–76, the drain line drivers 27–29 or 77–79 and the drain line drivers 30–32 or 80–82, and the drain lines DL1–DLn are separated into nine groups accordingly. The present invention is not however limited to this particular arrangement. The present invention can be applied to every case where the drain line drivers may be separated into two or more groups each consisting of two or more drain line drivers, so that the drain lines DL1–DLn can be separated into four or more groups. In this case, as the number of the groups of the drain lines DL is increased, the frequency of the clock signal can be set lower.

What is claimed is:

1. A display driving apparatus comprising:

a display panel having a plurality of display elements laid out on a substrate in a predetermined pattern;

a data side driver section, formed on said substrate, for supplying data to said display elements, said data side driver section having a plurality of groups each including a plurality of data side drivers;

a column of data lines arranged in parallel, each of said data lines being connected to a plurality of display elements and to one of said data side drivers which is associated with a position of a column of said connected display elements;

a scan side driver for scanning said display elements;

a plurality of scan lines, each for connecting a plurality of display elements to said scan side driver;

clock signal supply means for generating a plurality of common clock signals whose phases are shifted from each other, and for supplying different common clock signals to each group of data side drivers and each of the different clock signals being applied to corresponding data side drivers in each of said groups; and data signal supply means for supplying a common data signal to all of said data side drivers in each of said groups, group by group, said data signal supply means having a plurality of data signal lines respectively connected to all of said data side drivers in each of said groups.

2. The display driving apparatus according to claim 1, wherein each group of said data side drivers includes a same number of data side drivers.

3. The display driving apparatus according to claim 2, wherein the number of data side drivers in a group is S, and individual data lines in said column of data lines are connected to a same data side driver with (S−1) data lines, connected to other data side drivers in a same group, in between.

4. The display driving apparatus according to claim 1, wherein the number of said groups is r and the number of data side drivers in a group is S, and individual data lines in said column of data lines are connected to a same data side driver with (r·S−1) data lines, connected to other data side drivers, in between.

5. The display driving apparatus according to claim 1, wherein said scan side driver is formed on said substrate.

6. The display driving apparatus according to claim 1, wherein said clock signal supply means has a plurality of clock signal lines connected to associated data side drivers in each of said groups.

7. The display driving apparatus according to claim 6, wherein said clock signal supply means includes a clock signal generator for frequency-dividing a reference clock signal to a reciprocal of a product of the number of said groups and the number of said data side drivers constituting each group and for generating clock signals whose phases are shifted by phase angles corresponding to said number of said data side drivers constituting each group.

8. The display driving apparatus according to claim 7, wherein said clock signal generator has a first counter for frequency-dividing said reference clock signal in accordance with said number of said groups, and second counters, equal in number to said number of said data side drivers constituting each group, for frequency-dividing a clock signal output from said first counter in accordance with said number of said data side drivers constituting each group.

9. The display driving apparatus according to claim 1, wherein said data signal supply means includes a data signal generator for separating one scan line of input video signals in accordance with the number of said groups and for respectively supplying said separated video signals to said data signal lines.

10. The display driving apparatus according to claim 9, wherein said data signal generator has shift registers equal in number to said number of said groups.

11. A display driving apparatus comprising:

a display panel having a plurality of display elements laid out on a substrate in a predetermined pattern;

a data side driver section, formed on said substrate, for supplying data to said display element said data side driver section having a first data side driver, a second data side driver, a third data side driver, and a fourth data side driver;

a scan side driver for scanning said display elements;

a first data signal supply means for supplying a first common data signal to said first data side driver and to said second data side driver;

a second data signal supply means for supplying a second common data signal to said third data side driver and to said fourth data side driver;

a first clock signal supply means for supplying a first common clock signal to said first data side driver and to said third data side driver, said first common clock signal having a first phase;

a second clock signal supply means for supplying a second common clock signal to said second data side driver and to said fourth data side driver, said second common clock signal having a second phase which is different from said first phase of said first common clock signal.

* * * * *